US005530428A

United States Patent [19]

Woods

[11] Patent Number: 5,530,428

[45] **Date of Patent: *Jun. 25, 1996**

[54] SECURITY ALARM SWITCH

[76] Inventor: Randall Woods, 230 Longbranch East, Prescott, Ariz. 86303

[ * ] Notice: The term of this patent shall not extend beyond the expiration date of Pat. No. 5,332,992.

[21] Appl. No.: 488,825

[22] Filed: Jun. 9, 1995

Related U.S. Application Data

[63] Continuation of Ser. No. 200,143, Feb. 23, 1994, abandoned, which is a continuation-in-part of Ser. No. 43,216, Apr. 6, 1993, Pat. No. 5,332,992.

[51] Int. Cl.[6] ..... G08B 13/08; H01H 9/00; H01H 3/16

[52] U.S. Cl. ..... 340/547; 340/545; 335/205; 200/61.7

[58] Field of Search ..... 340/545, 547, 340/571, 689, 429; 341/32; 335/205, 207; 116/85, 86; 200/61.7, 61.71, 61.72, 61.73, 61.45 R, 61.45 M, 61.53, 61.62, 61.84, 61.93

[56] References Cited

U.S. PATENT DOCUMENTS

| | | | |
|---|---|---|---|
| 1,051,962 | 2/1913 | Lundquist | 116/86 |
| 1,192,893 | 8/1916 | Harvey | 116/88 |
| 1,868,923 | 7/1932 | Semon | 116/88 |
| 3,516,036 | 6/1970 | Lea | 335/207 |
| 3,535,664 | 10/1970 | Staar | 335/153 |
| 3,630,168 | 12/1971 | Fladlay | 116/74 |
| 3,650,347 | 3/1972 | Campos | 180/282 |
| 3,763,484 | 10/1973 | Byers | 340/429 |
| 3,816,680 | 6/1974 | Suzuki et al. | 200/61.51 |
| 3,842,377 | 10/1974 | Barndt | 335/207 |
| 4,042,796 | 8/1977 | Zink | 200/61.45 R |
| 4,057,773 | 11/1977 | Cohen | 335/205 |
| 4,062,314 | 12/1977 | Allen et al. | 116/85 |
| 4,168,410 | 9/1979 | Norris | 200/61.45 R |
| 4,275,391 | 6/1981 | Okamura | 340/571 |
| 4,293,860 | 10/1981 | Iwata | 340/429 |
| 4,326,196 | 4/1982 | Plevy | 340/545 |
| 4,336,518 | 6/1982 | Holce et al. | 335/205 |
| 4,450,326 | 5/1984 | Ledger | 200/61.45 M |
| 4,456,897 | 6/1984 | Holce et al. | 335/205 |
| 4,553,134 | 11/1985 | Holt | 340/545 |
| 4,567,846 | 2/1986 | Kurtz | 116/86 |
| 4,628,160 | 12/1986 | Canevari | 200/61.52 |
| 4,656,458 | 4/1987 | Iwata | 340/689 |
| 4,733,324 | 3/1988 | George | 200/61.45 R |
| 4,788,517 | 11/1988 | Meister | 335/205 |
| 4,982,058 | 1/1991 | Schroeder et al. | 200/61.62 |
| 5,192,839 | 3/1993 | Imade et al. | 200/61.45 M |
| 5,248,861 | 9/1993 | Kato et al. | 200/61.45 R |
| 5,248,959 | 9/1993 | Chern | 200/61.45 R |
| 5,332,992 | 7/1994 | Woods | 340/547 |

*Primary Examiner*—Safet Metjahic
*Assistant Examiner*—John W. Miller
*Attorney, Agent, or Firm*—Hovey, Williams, Timmons & Collins

[57] ABSTRACT

A magnetic switch assembly (10) is provided for detecting relative movement between first and second adjacent members (14, 18), and to defeat attempted magnetic manipulation of the assembly (10). The assembly (10) includes a pair of adjacent, superposed, upper and lower switch elements (22, 24) adapted for mounting on the first member (14), with the lower switch element (24) presenting a sloped surface (26). A shiftable, ferromagnetic ball (34) is disposed between the elements (22, 24) and movable along surface (26) between spaced upper and lower switch operating positions. A magnet (36) adapted for mounting on the second member (18) is also provided, and is oriented for normally retaining the ball (34) in the upper position thereof; however, upon movement of the member (18), the ball (34) is permitted to shift downwardly along the sloped surface (26) to the lower switch operating position thereof. Attempted magnetic manipulation via external magnet (48) also causes the ball (34) to shift from the upper to the lower position thereof. The respective switch assemblies (10, 46, 56, 84, 124, and 144) are capable defeating attempted external magnetic manipulation as ball 34 traverses transversely oriented elongated paths of travel (P1 and P2, P3 and P4, or P5, P6 and P7) responsive to external magnetic forces.

30 Claims, 3 Drawing Sheets

Fig. 1.
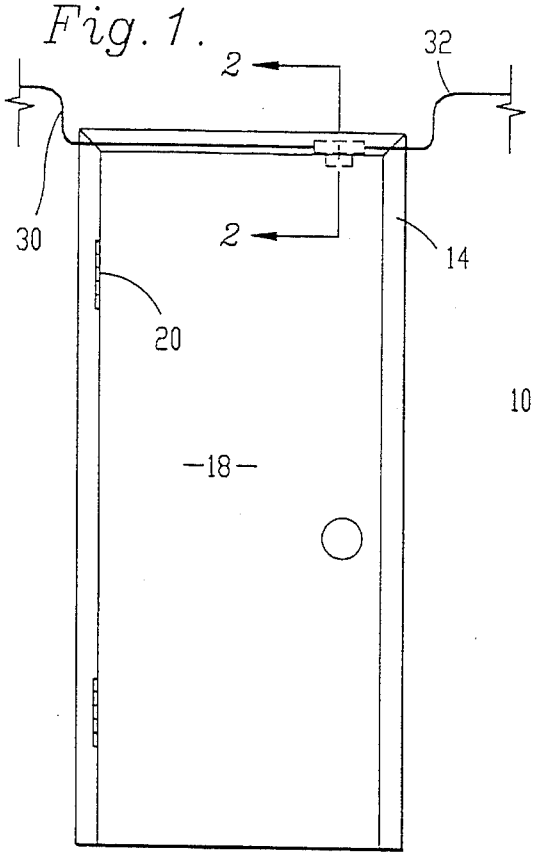
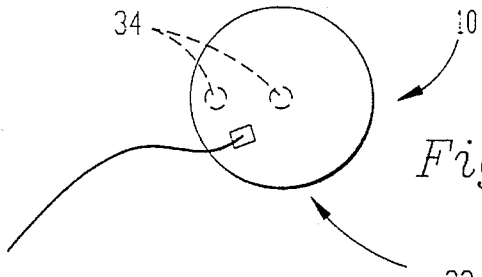
Fig. 5.
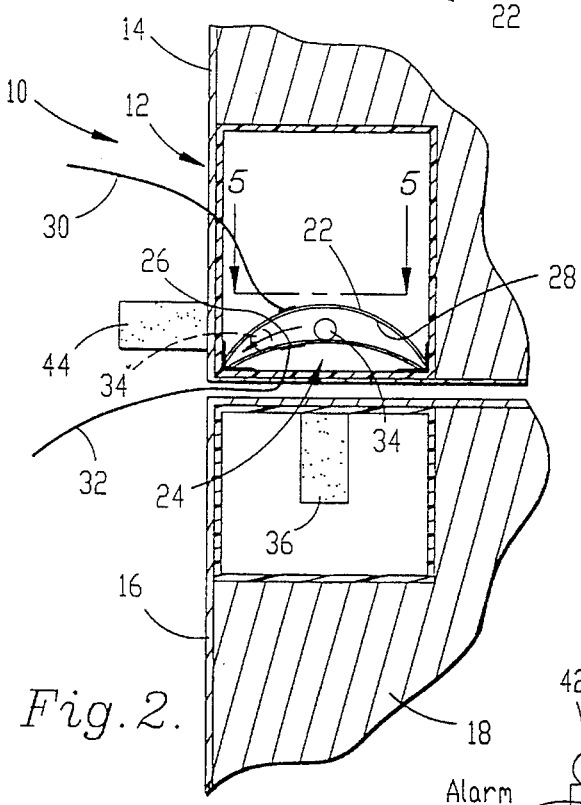
Fig. 2.
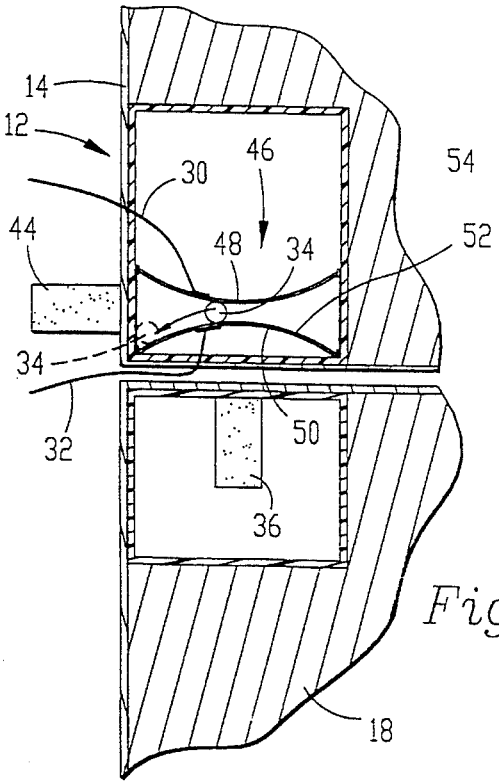
Fig. 3.
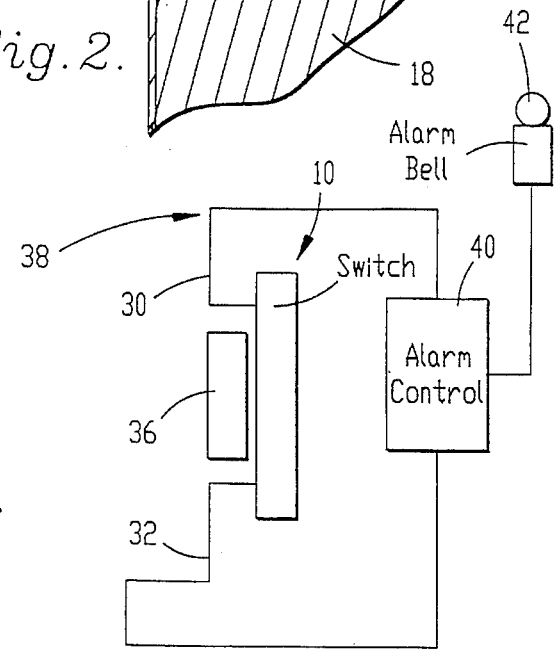
Fig. 4.

SECURITY ALARM SWITCH

RELATED APPLICATIONS

This application is a continuation of application Ser. No. 08,200,143, filed Feb. 23, 1994 now abandoned, which is a continuation-in-part of Ser. No. 08/043,216, filed Apr. 6, 1993, now U.S. Pat. No. 5,332,992.

BACKGROUND OF THE INVENTION

1. Field of the Invention

The present invention is broadly concerned with an improved magnetic switch assembly of the type used in conjunction with a security system to detect unauthorized entry through doors or windows. More particularly, it is concerned with such a switch assembly which is especially configured to defeat attempted magnetic manipulation of the switch assembly so as to permit opening of the door or window without detection thereof. To this end, the switch assembly includes a pair of adjacent, first and second switch elements mountable within a stationary frame, with a shiftable ferromagnetic body disposed between the elements and movable between spaced upper and lower switch operating positions. The ferromagnetic body is at least shiftable along first and second elongated paths, with each of the paths presenting a longitudinal axis having a transverse orientation with respect to the other path. A magnet is mounted in the movable door or window and is oriented for effecting movement of the body upon opening of the door or window between switch operating positions. In the event that an external magnet is placed adjacent the switch elements during an attempted unauthorized entry, the ferromagnetic body is moved to the lower switch position, thereby detecting such attempted manipulation.

2. Description of the Prior Art

Modern-day building security alarm systems make use of door and window switch assemblies which are designed to detect unauthorized opening thereof. For example, one common switch assembly for this purpose includes a pair of magnetic reed switch elements mounted in a door or window frame, with a magnet carried by the adjacent openable door or window. The magnet carried by the door or window hold the reed elements opened or closed (depending on whether the switch is of the normally opened or normally closed variety) when the door or window is closed; when the latter is opened, the reed switch elements change position. These reed switches are conventionally interposed in the overall alarm circuit, so that upon unauthorized opening of the door or window, the switch operation generates an alarm signal.

One problem with conventional reed switch assemblies of the type described is that they can be readily defeated by simply placing an external magnet adjacent the door or window frame in proximity to the reed switch elements. This allows the door or window to be opened, but the reed switches do not change their positions, owing to the presence of the magnetic field attendant to the external magnet. As a consequence, an intruder may with impunity open the door or window and gain unauthorized access to the seemingly protected building.

There is accordingly a real and unsatisfied need in the art for an improved switch assembly which is designed to defeat attempted magnetic manipulation thereof, and to initiate alarm operation even when an external magnet is employed.

SUMMARY OF THE INVENTION

The present invention overcomes the problems outlined above, and provides a magnetic switch assembly for detecting relative movement between first and second adjacent members such as a door or window relative to its circumscribing frame. At the same time, the switch assembly defeats attempted magnetic manipulation thereof.

Broadly speaking, the switch assembly of the invention includes a pair of adjacent, superposed, upper and lower switch elements for mounting on the first member (e.g., the stationary frame), with the lower switch element presenting a sloped surface. The assembly further includes a shiftable, ferromagnetic body such as a ball which is disposed between the switch elements and movable along the sloped surface between spaced upper and lower switch operating positions. A magnet is also provided for mounting on the second member (e.g., the movable door or window) and is oriented for retaining the ferromagnetic body in its upper switch operating position when the first and second members are in one relative position (e.g., the door or window being closed). However, upon movement of the first and second members to a different position (e.g., the door or window being opened), the body is permitted to shift along the sloped surface to the lower switch operating position where it is retained under the influence of gravity.

Very importantly, the switch elements are located within the first member for movement of the ferromagnetic body from the upper to the lower switch operating positions, when the members are in the first relative position and an external magnet is applied to the second member in an attempt to magnetically manipulate and defeat the switch assembly.

In preferred forms, the switch elements are each of concavo-convex configuration, and are generally circular in plan. these switch elements are adapted for respective electrical coupling via wire leads into an overall alarm system.

The switch assembly of the invention may be configured as normally opened or normally closed. In the first instance, a normally open switch assembly may included a lower switch element presenting an uppermost convex surface, while the adjacent surface of the upper element is concave; the ferromagnetic ball is adapted in the upper position thereof to rest upon the apex of the lower convex surface, in spaced relationship to the adjacent concavo-convex switch element. Where a normally closed switch assembly is desired, the upper surface of the lower element is again convex, and the adjacent lower surface of the upper element is also convex, but oppositely diverging. In this instance, the ferromagnetic ball in the upper position thereof contacts both of the switch elements, thus closing the switch.

Another aspect of the invention pertains to a housing including marginal wall structure defining a cavity having spaced apart first and second electrical contacts, and a shiftable ferromagnetic ball or element retained within the cavity. The ferromagnetic element is shiftable between a first position where it simultaneously engages the first and second contacts, and a plurality of second positions where the element is disengaged from the first and second contacts. Additionally, the ferromagnetic element is shiftable along first and second elongated paths of travel each presenting a longitudinal axis; the longitudinal axis of the first or second paths each having a transverse orientation relative to the other path.

As those skilled in the art will appreciate, the switch assembly of the invention may be readily interposed within an overall intruder alarm system, the latter including an alarm circuit for detecting the opening of a door or window. In such a case, the described electrical leads are connected within the system, so that upon attempted forced opening of the door or window, with or without use of an external magnet, the alarm will activate.

BRIEF DESCRIPTION OF THE DRAWINGS

FIG. 1 is an elevational view of a hingedly mounted door protected by a switch assembly in accordance with the invention, the latter being illustrated partially in phantom and shown interposed within an intruder alarm system;

FIG. 2 is an enlarged, fragmentary vertical sectional view of a door-mounted, normally opened switch assembly in accordance with the invention, and also illustrating attempted magnetic manipulation of the switch assembly via an external magnet;

FIG. 3 is a view similar to that of FIG. 2, but illustrating a normally closed switch assembly in accordance with the invention;

FIG. 4 is a schematic representation of an alarm system, with the switch assembly of the invention interposed therein;

FIG. 5 is a view taken along line 5—5 of FIG. 2 and illustrating the upper switch element, with two positions of the internal switch ball depicted in phantom;

DETAILED DESCRIPTION OF THE PREFERRED EMBODIMENTS

Figure 8:
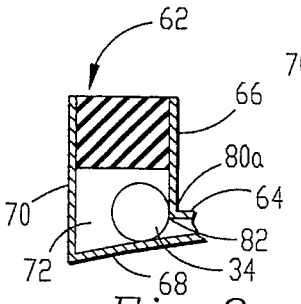
FIG. 8 is a fragmentary sectional view of the FIG. 6 embodiment including a different relief feature at a first position where the ferromagnetic body bridges a gap between electrical contacts.

Turning now to the drawings, and particularly FIGS. 1–2, a switch assembly 10 is illustrated. The assembly 10 includes an uppermost synthetic resin housing 12 adapted for mounting within a stationary door or window frame 14, as well as a mating synthetic housing 16 which is positioned within the movable door 18. As shown in FIG. 1, the door 18 is of the conventional type, and is mounted on hinges 20 for movement between a closed position and a door opened position.

Referring specifically to FIG. 2, it will be observed that the upper housing 12 includes a pair of adjacent, superposed, upper and lower switch elements 22, 24, each of generally circular, disc-like, concavo-convex configuration. Specifically, the lower element 24 presents an uppermost convex surface 26, whereas the adjacent element 22 has a concave lower surface 28 in facing relationship to the surface 26. A pair of electrical leads 30, 32 are respectively electrically connected with the upper and lower switch elements 22, 24 as shown.

A ferromagnetic ball 34 is positioned between the switch elements 22, 24 and is movable between an uppermost rest position illustrated in bold lines in FIG. 2, to a lower, switch closing position depicted in phantom. In the latter position, it will be observed that the ball 34 comes into electrical, switch-closing contact with the elements 22, 24 in the lower position thereof.

The lower housing 16 includes a magnet 36 which is strategically oriented so that, when the door 18 is closed as shown in FIG. 2, the magnetic field generated by the magnet 36 causes the ball 34 to be retained in the upper, switch open position thereof.

However, when door 18 is opened, the magnet 36 pulls ball 34 downwardly along the sloped uppermost surface 26 of the lower switch element 24, thereby moving the ball to the lower switch closing position thereof. When the door 18 is fully opened, the ball 34 remains in this lower position under the influence of gravity. Of course, when the door 18 is again closed, the ball 34 is magnetically pulled from its lower position back to the upper, switch open position shown in full lines in FIG. 2, where ball 34 rests at the apex of surface 26.

As shown in FIG. 4, the switch assembly 10 is adapted for mounting within and as a part of an alarm system 38. The latter includes an alarm control assembly 40 as well as an alarm bell 42 or other perceptible alarm device. As shown, the electrical leads 30, 32 are used to interpose the switch assembly 10 within the system 38. Thus, if the alarm system 38 is armed, any attempted opening of door 18 will close switch assembly 10, and alarm signal will be generated to ring bell 42 (or alert a central station, for example). Again referring to FIG. 2, if an intruder attempts to apply an external magnet 44 to frame 14 to defeat switch assembly 10, this has the effect of initiating alarm operation. That is to say, use of the external magnet 44 moves ball 34 down the sloped surface 26 until the ball comes into the lower switch-closing position thereof. At this point, the alarm system 38 is activated, even though the door 18 is not actually opened. Thus, in such situations the present invention provides the earliest possible warning of attempted forced entry.

FIG. 3 illustrates a second embodiment of the invention which includes a normally closed switch assembly 46. Specifically, the upper housing 12 within frame 14 includes adjacent disc-like switch elements 48, 50. The lower switch element 50 presents an uppermost concave surface 52, while the upper element 48 presents a lower concave surface 54; it will be noted that the concave surfaces 52, 54 are relatively divergent, and approach each other at the center of the discs. Magnetic ball 34 positioned between the discs completes the upper portion of the switch assembly. As illustrated, in the upper position of the ball depicted in full lines, the switch is closed. When the door 18 is opened, magnet 36 serves to move the ball 34 downwardly along the sloped surface 52 to the lower switch-open position illustrated in phantom in FIG. 3. Attempted magnetic manipulation of the assembly 46 via external magnet 44 is also defeated in this embodiment. That is, the presence of external magnet 44 simply pulls ball 34 to its lower position, and allows the overall alarm system 38 to appropriately activate and react.

Figure 6:
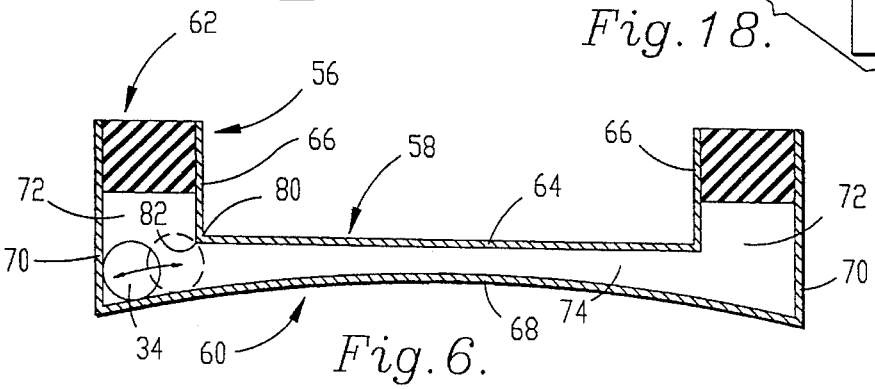
FIG. 6 depicts a third embodiment including a relief feature presenting an improved electrical contact in sectional view taken along line 6'—6' of FIG. 7.

FIG. 6 depicts a third embodiment of the invention where like numbering is retained for identical components with respect to the FIG. 3 embodiment. The third embodiment includes a normally closed switch assembly 56 having metallic upper switch element 58, downwardly sloping concavo-convex lower metallic switch element 60, dielectric coupling ring 62, and steel ball 34. Upper element 58 forms a cylindrical well defined by horizontally extending bottom member 64 and vertical wall 66. Lower element 60 includes a downwardly sloping concavo-convex bottom wall 68 bounded by vertical side wall 70.

Figure 7:
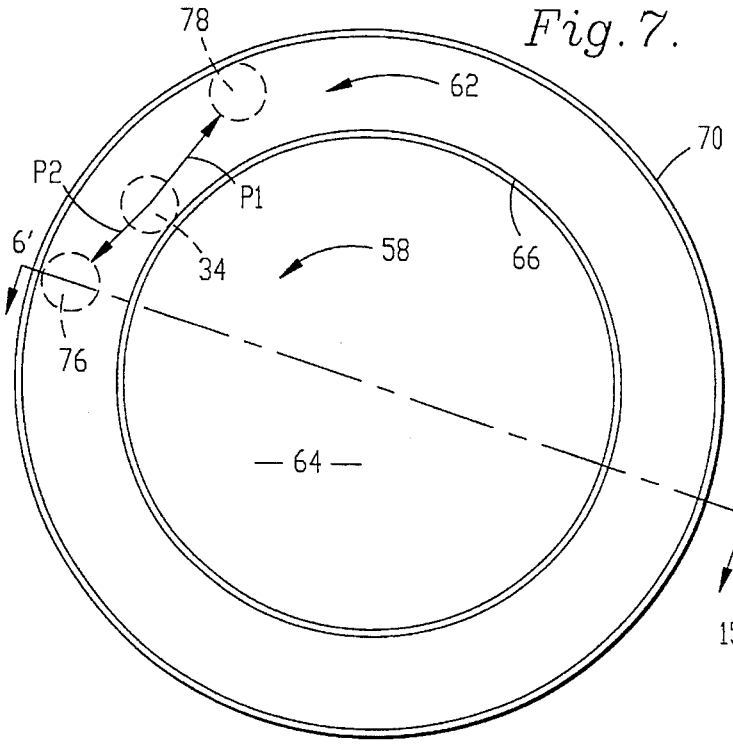
FIG. 7 is a top view of the FIG. 6 embodiment depicting a plurality of paths of travel for the ferromagnetic body.

In FIG. 7, dielectric coupling 62 presents an annular structure holding elements 58 and 60 in a concentric relationship. Coupling 62 may be formed of neoprene rubber, synthetic resin, or similar insulative material. Additionally, ring 62 may be adhered to elements 58 and 60, or may be compressed to frictionally engage the elements. In this manner, ferromagnetic ball 34 may be positioned within peripheral zone 72 of opening 74 formed between elements 58 and 60. Ball 34 is depicted in a first position of electrical contact bridging opposed elements 58 and 60, and may be shifted along numerous transversely oriented elongated paths, e.g., paths P1 and P2, towards a plurality of second positions, e.g., position 76 and 78 where ball 34 is no longer in simultaneous electrical contact with elements 58 and 60.

Figure 9:
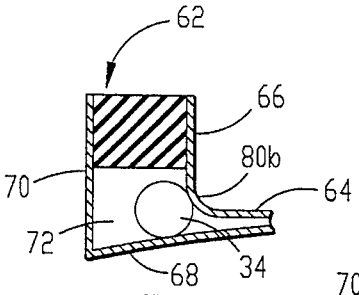
FIG. 9 is a fragmentary sectional view similar to that of FIG. 8, but having a different surface relief feature.
Figure 10:
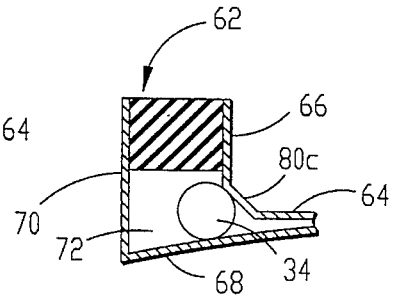
FIG. 10 is a fragmentary sectional view similar to that of FIG. 8, but having yet another surface relief feature.

A variety of surface relief features, e.g., right angle corner 80 having apex 82 (FIG. 6), for contacting ball 34, may be provided. FIG. 8 depicts relief feature 80*a*, which is a right-angle corner similar to relief feature 80 except that wall 68 is positioned relatively closer to wall 64 which causes ball 34 to engage wall 66, not apex 82. FIG. 9 depicts yet another relief feature 80*b* which includes an arcuate ball-engaging contour at the lower portion of circular vertical wall 66. FIG. 10 depicts yet another relief feature 80*c*, which includes a 45° ball-engaging bevel at the lower portion of circular vertical wall 66.

In operation, switch assembly 58 is mounted in the manner previously described with a magnet, such as magnet 36, positioned in a door below the switch and proximal to the center portion thereof. The magnet serves to attract and hold ball 34 in continuous electrical contact with wall 68 and the various relief features, e.g., feature 80. If the door is opened, magnet 36 is pulled away from the switch 56 to release ball 34 from its first position of simultaneous contact with elements 58 and 60, after which ball 34 rolls down sloped wall 68 along a path of travel, e.g., P2, towards one of the second positions where ball 34 is disengaged from contacts 58 and 60 to break the electrical contact and set off an alarm. Similarly, in the event that external magnetic forces are applied to manipulate ball 34 in an attempt to defeat the alarm circuit, ball 34 may be shifted along another path such as paths P1 or P2 to one of the second positions 76 or 78; thereby activating an alarm.

The various relief features 80, 80*a*, 80*b*, and 80*c* are particularly preferred for various reasons. The open peripheral zone 72 provides space for ball 34 to move therein without risking the ball becoming stuck between walls 64 and 68 in the narrowed central region. Relief feature 80 presents a sharp apex 82, which tends to provide a relatively sharp surface forming a better electrical contact between apex 82, ball 34 and wall 68. Feature 80*a* does not utilize sharp corner 82 to enhance the electrical contact, but merely presents wall 66 as an abutment to exclude ball 34 from the central narrowed region between walls 64 and 68. Feature 80*b* excludes ball 34 from the central narrowed region in a similar manner, as does feature 80*c*.

Figure 11:
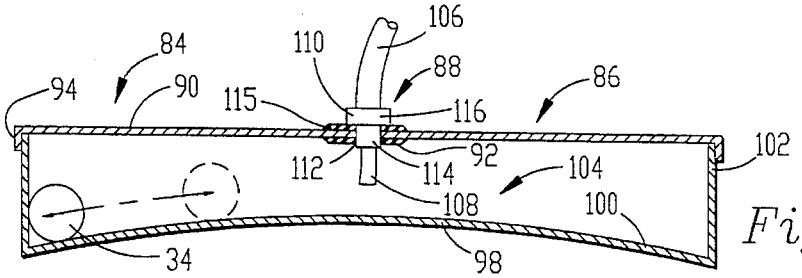
FIG. 11 is a sectional view depicting a fourth embodiment of the invention having a substantially planar upper element including a centrally positioned flexible metallic contact.

FIG. 11 depicts a fourth embodiment of the invention where like numbering is retained for identical components with respect to the FIG. 6 embodiment. Switch 84 includes a first chamber-defining switch element 86; ball 34; and a second, flexible switch element 88. First switch element 86 includes a substantially flat, circular metallic upper disk 90 having a central aperture 92 for receiving element 88 (see FIGS. 11 and 13), and an outer lip 94 at its outer radius. Element 86 also includes a bottom portion 96 having a central, circular, disk-like, concavo-convex, bottom wall 98 presenting an uppermost downwardly sloping surface 100, and a cylindrical vertically rising side wall 102 integrally formed with wall 98 and having a radius sufficient to fit within lip 94. Wall 102 and lip 94 may have a solder connection to form a closed interior chamber 104 for holding ball 34. Element 86 may be connected at any point on the exterior thereof with an electrical lead (not depicted) for incorporating switch 84 into an electrical alarm system.

Figure 12:
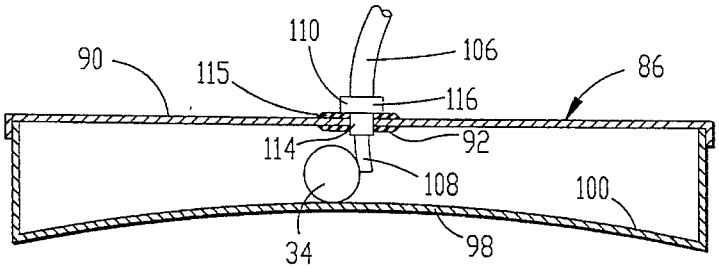
FIG. 12 is a sectional view of the FIG. 11 embodiment depicting the metallic contact flexed by the ferromagnetic body in a central first position where the body bridges a gap between contacts.

Second switch element 88 includes conductive lead 106, which may be connected with the wiring of an electrical alarm system, and is electrically coupled with spring steel rod 108. Rod 108 extends into chamber 104 a sufficient distance to contact ball 34 in a first position simultaneously bridging a gap between rod 108 and wall 98, as depicted in FIG. 12. Rod 108 is held by mounting bracket 110 having a lowermost tubular portion 112 sized to be received within aperture 92, and presenting a central aperture 114 for receiving rod 108. Lower portion 112 is integrally formed with upper portion 116 having an increased radiant diameter and continuing aperture 114 for receiving rod 108. Circular rubber grommet 115 frictionally retains bracket 110 within aperture 92.

Figure 13:
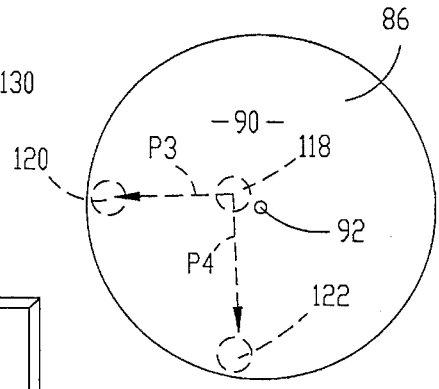
FIG. 13 is a top view of the FIG. 10 embodiment.

FIG. 13 depicts ball 34 having a central first position 118 simultaneously bridging the gap between rod 108 and surface 100, and a plurality of alternative positions, e.g., 120 and 122, where ball 34 is disengaged from contact with rod 108. In the event that switch 84 is removed from proximity of an external magnet (e.g., magnet 36) serving to retain ball 34 in position 118, or if external magnetic forces are applied in an attempt to defeat the alarm circuitry, ball 34 may travel along one of paths P3 and P4, each presenting an axis of elongation having a transverse orientation with respect to the other path and traveling towards a plurality of second positions, e.g., 120 and 122, at the outer perimeter of switch 84 where ball 34 is disengaged from contact with rod 34 and surface 100.

In operation, switch 84 is mounted above a door in the manner depicted in FIG. 1, with magnet 36 centrally positioned beneath switch 84. When the door is closed, magnet 36 pulls ball 34 into contact with rod 108, which may flex responsively as depicted in FIG. 12. In this position, where ball 34 closes the gap between surface 100 and rod 108, the alarm circuit is closed to indicate that the door is shut. Upon opening the door, or upon attempted external magnetic manipulation, ball 34 may roll along one of exemplary paths P3 and P4 down surface 100 to one of the extreme outer second positions 120 and 122 shown in FIG. 11, thus breaking the closed circuit to indicate that the door is open.

Figure 14:
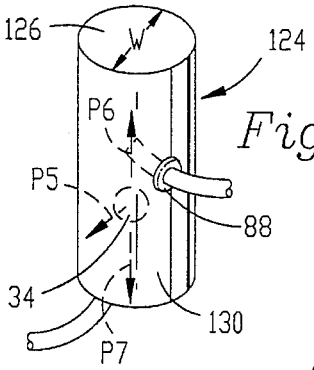
FIG. 14 is a left front perspective view of a fifth embodiment that may be utilized to detect entry through a window.

FIG. 14 depicts a fifth embodiment of the invention where like numbering has been retained for identical components with respect to the FIG. 11 embodiment. Switch 124 may be mounted for use at the side of a window, and includes a closed cylindrical shell 126 coupled with switch element 88 as previously described.

Figure 16:
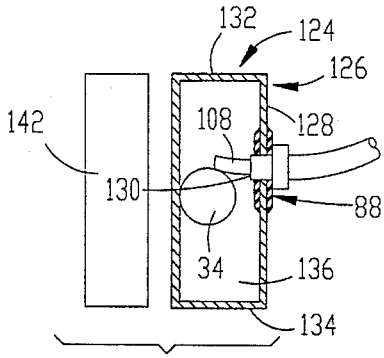
FIG. 16 is a left side sectional view of the FIG. 14 embodiment with the ferromagnetic body pulled upwardly by a magnet to contact a flexible electrical contact.

As depicted in FIG. 16, shell 126 includes a tubular side wall 128 having aperture 130 for receiving switch assembly 88, top wall 132, and bottom wall 134, which combine to form a closed interior chamber 136 for retaining ball 34. Element 88 is received within wall 128 in a manner which is identical to that described for disk 90 of the FIG. 11 embodiment, except rod 108 extends into chamber 136 in a horizontal orientation. Ball 34 is depicted (FIG. 16) in a first position of electrical contact bridging the gap between rod 108 and wall 128, but may travel along paths P5, P6, and P7. Path P5 (FIG. 14) travels along a width dimension W of sufficient dimension to allow vertical passage of ball 34 between rod 108 and wall 128 along elongated paths P6 and P7 each having transverse orientations with respect to path P5.

Figure 17:
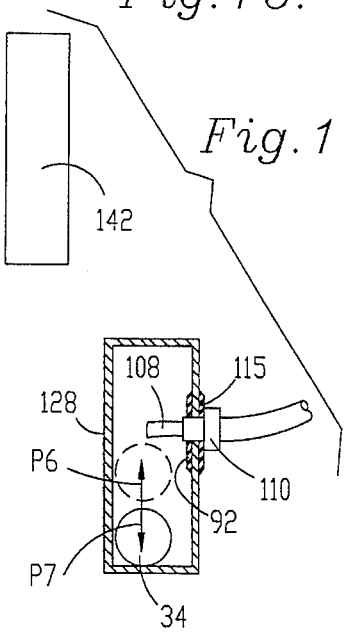
FIG. 17 is a left side sectional view of the FIG. 14 embodiment with the ferromagnetic body having fallen under the influence of gravity after removal of the magnet.
Figure 15:
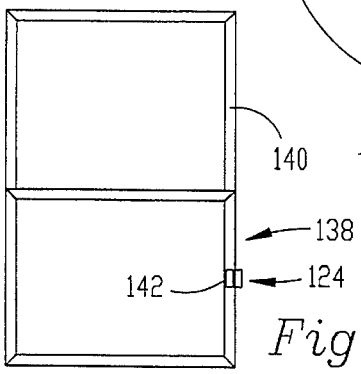
FIG. 15 depicts the FIG. 14 embodiment installed proximal to a magnet on an actual window.

In operation, switch 124 may be mounted within an upright wall, such as wall 138 proximal to window 140 (see FIG. 15), which holds magnet 142. FIG. 16 depicts ball 34 in a first position simultaneously contacting wall 128 and rod 108 to form a closed circuit where magnet 142 retains ball 34 in a position to indicate that the window is closed. FIG. 17 depicts ball 34 having fallen with the force of gravity along downward path P7 upon the removal of magnet 142 from the proximity of wall 128 to open the circuit, thus, indicating that the window has been raised. In the event that external magnetic forces are applied from outside window 140, ball 34 may shift along path P5 to disengage from simultaneous contact with rod 108 and wall 128, thereby triggering an alarm.

Figure 18:
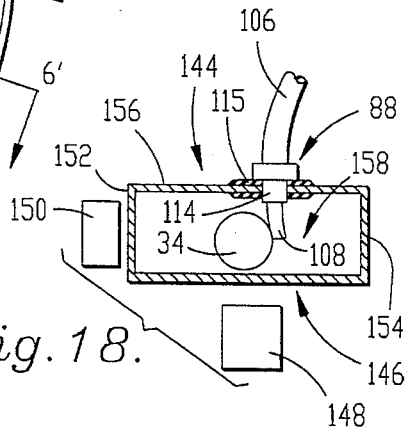
FIG. 18 is a front sectional view of a sixth embodiment wherein the spherical body is moved by magnetic forces rather than gravitational forces to activate an alarm circuit.

FIG. 18 depicts a final embodiment including switch assembly 144, switch element 88, switch element 146, magnet 148, and magnet 150, where like numbering has been retained with respect to the FIG. 14 embodiment. Switch element 88 is constructed as previously described. Switch element 146 is a cylindrical shell having end walls 152 and 154 connected by tubular sidewall 156 to form interior chamber 158 for retaining ball 34. A top wall 156 is apertured to receive switch element 88 as previously described. Element 146 is identical to shell 126, except that 146 is designed for installation with rod 108 in a vertical position.

Figure 19:
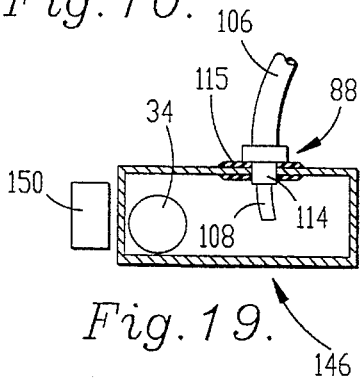
FIG. 19 is a front sectional view of the FIG. 18 embodiment depicting the spherical body having moved away from an electrical contact to open the switch circuit.

Switch assembly 144 is designed for horizontal installation, with switch elements 88 and 146 preferably being positioned in the uppermost portion of a door jam. Magnet 148 is preferably placed in the door at a position that will be aligned directly underneath switch element 88 when the door is closed. Magnet 148 is larger than magnet 150, and will pull ball 34 away from magnet 150 towards a central first position contacting switch elements 88 and 146 to close the electrical circuit when the door is closed. When the door is open, magnet 148 is removed from proximity with ball 34, and magnet 150 pulls ball 34 away from element 88, thus opening the circuit in the position depicted in FIG. 19 to indicate that the door is open.

Those skilled in the art will understand the preferred embodiments, as described hereinabove, may be subjected to obvious modifications without departing from the scope and spirit of the invention. The inventor hereby states his intention to rely upon the Doctrine of Equivalents, as well as all other remedies afforded by law.

I claim:

1. A magnetic switch assembly for detecting relative movement between first and second adjacent members, comprising:

switch means for mounting on one of said members and including a housing supporting a pair of spaced switch elements;

a ferromagnetic body within said housing and movable therein between a first switch closed position wherein said body is in simultaneous contact with said pair of spaced switch elements and a second switch open position wherein said body is out of said simultaneous contact; and means for biasing said ferromagnetic body into one of said first and second positions; and a first magnet for mounting on said second member and oriented for retaining said ferromagnetic body against the bias of said biasing means in the other of said first and second positions when the first and second members are in relative adjacency, said biasing means being operable for moving said body to said one of said first and second positions upon relative movement between the first and second members.

2. The switch assembly of claim 1, said biasing means comprising a second magnet mounted on said first member adjacent said housing.

3. A magnetic switch assembly for detecting relative movement between first and second adjacent members, and for defeating attempted magnetic manipulation of the switch assembly so as to permit said relative movement without detection thereof, said switch assembly comprising:

a housing for mounting on said first member and including side marginal wall structure defining a cavity, a first electrical contact positioned within said cavity and between opposed portions of said side marginal wall structure, and a second electrical contact spaced from said first contact;

a shiftable ferromagnetic element within said housing cavity and configured for simultaneous engagement with first and second contacts to present a first switch position;

said housing cavity being configured for permitting movement of said element from said first switch position to a plurality of second switch positions wherein the element is out of simultaneous engagement with said first and second contacts, said element being movable between said first and second switch positions along at least first and second elongated paths of travel each presenting a longitudinal axis, the longitudinal axis of said first and second paths being transverse relative to each other;

magnetic means for mounting on said second member for, when the first and second members are relatively stationary in a desired position, retaining said element in one of said first and second switch operating positions and, upon relative movement between the first and second members, permitting said element to shift along said first path of travel to the other of said switch operating positions;

said housing and element being cooperatively configured for, when the first and second members are in said desired position and an attempt is made to magnetically manipulate the switch assembly, movement of the element along said second path to other switch operating positions thereof, whereby to defeat said attempted magnetic manipulation.

4. The switch assembly as set forth in claim 3, said side marginal wall structure including a rectangular box.

5. The switch assembly as set forth in claim 3, said shiftable ferromagnetic body including a steel sphere.

6. The switch assembly as set forth in claim 3, said first electrical contact including a flexible metallic reed.

7. The switch assembly as set forth in claim 6, said second electrical contact including a downwardly sloping surface on said side marginal wall structure.

8. The switch assembly as set forth in claim 7, including said first position located at the center of said downwardly sloping surface, and said second positions located outwardly away from said center.

9. The switch assembly as set forth in claim 3, said first electrical contact including a first metallic reed, said second electrical contact including a second metallic reed having a downwardly sloping surface.

10. The switch assembly as set forth in claim 9, said first metallic reed including an abutment for preventing said body from shifting to a central position between said first and second reeds.

11. A magnetic switch assembly for detecting relative movement between first and second adjacent members, and for defeating attempted magnetic manipulation of the switch assembly so as to permit said relative movement without detection thereof, said switch assembly comprising:

a pair of adjacent, superposed, upper and lower switch elements for mounting on said first member, said lower switch element presenting a sloped surface;

a shiftable, ferromagnetic body disposed between said elements and movable along said sloped surface between spaced upper and lower switch operating positions; and a magnet for mounting on said second member and oriented for retaining said body in said upper switch operating position when said members are in one relative position, and, upon movement of the members to a second relative position, for permitting shifting of said body along said sloped surface to said lower switch operating position for retention thereat under the influence of gravity, said switch elements providing a peripheral zone for receipt of said body wherein said body may move between said upper and said lower switch operating positions upon the application or removal of external magnetic force.

12. The switch assembly of claim 11, one of said upper and lower switch elements including a surface relief feature protruding into said zone for promoting electrical contact between said upper element, said ball, and said lower element.

13. The switch assembly of claim 12, said surface relief feature selected from the group consisting of a right-angle corner having an apex, an arcuate contour, and a bevel.

14. A magnetic switch assembly for detecting relative movement between first and second adjacent members, and for defeating attempted magnetic manipulation of the switch assembly so as to permit said relative movement without detection thereof, said switch assembly comprising:

a first switch element having walls defining an interior chamber, said walls including an upper wall and a lower wall opposed from said upper wall, said lower wall having a downwardly sloped surface rising from a lower switch operating position towards a central upper switch operating position, said upper wall having structure defining an aperture proximal to said upper operating position;

a second switch element having a flexible protrusion extending into said chamber proximal to said upper operating position, received within said aperture and insulated to prevent electronic contact between said second switch element and said upper wall;

a shiftable, ferromagnetic body disposed between said elements and movable along said sloped surface between spaced upper and lower switch operating positions; and a magnet for mounting on said second member and oriented for retaining said body in said upper switch operating position when said members are in one relative position, and, upon movement of the members to a second relative position, for permitting shifting of said body along said sloped surface to said lower switch operating position for retention thereat under the influence of gravity.

15. The assembly as set forth in claim 14, said protrusion including a resiliently flexible metallic rod.

16. A magnetic switch assembly for detecting relative movement between first and second adjacent members, and for defeating attempted magnetic manipulation of the switch assembly so as to permit said relative movement without detection thereof, said switch assembly comprising:

a pair of switch elements including a first element having a contact wall rising from a lower switch operating position to an upper switch operating position, and a second element proximal to said upper switch operating position;

a shiftable, ferromagnetic body movable along said contact wall between the upper and lower switch operating positions;

means connecting said first and second switch elements to form an interior chamber containing said body;

a magnet for mounting on said second member and oriented for retaining said body in said upper switch operating position when said members are in one relative position, and, upon movement of the members to a second relative position, for permitting shifting of said body along said contact wall to said lower switch operating position for retention there at under the influence of gravity.

17. The switch assembly as set forth in claim 16, said second element including a flexible metal rod protruding into said chamber for contacting said body.

18. The switch assembly as set forth in claim 16, there being a closed chamber completely surrounding said body and supporting said pair of switch elements.

19. A magnetic switch assembly for detecting relative movement between first and second adjacent members, comprising:

a first switch element for mounting on said first member, having walls defining an interior chamber and presenting a central portion connecting opposed sides, said central portion having structure defining a aperture therethrough;

a second switch element for mounting on said second member and having a flexible electrical contact received through said aperture;

a shiftable, ferromagnetic body disposed between said elements and moveable within said chamber between an open circuit position contacting one of said sides, and a closed circuit position contacting both said first switch element and said second element;

a first magnet for mounting on said first member and oriented for retaining said body in said open circuit position; and a second magnet for mounting for mounting on said second member and oriented for retaining said body and said closed circuit position, one of said first and second magnets having a stronger magnetic pull on said body for detaching said body from the other magnet as said first and second members are moved.

20. A magnetic switch assembly for detecting relative movement between first and second adjacent members, and for defeating attempted magnetic manipulation of the switch assembly so as to permit said relative movement without detection thereof, said switch assembly comprising:

a housing having opposed upper and lower walls and presenting a pair of adjacent, superposed, upper and lower switch elements, said housing being adapted for mounting on said first member, said lower switch element presenting a sloped surface;

a shiftable, ferromagnetic, substantially spherical body within said housing and shiftable along said sloped surface between spaced upper and lower switch operating positions, said body in one of said upper and lower positions being out of contact with said upper switch element, said body in the other of said upper and lower positions being in simultaneous contact with said upper and lower switch elements; and a magnet for mounting in said second member and oriented for retaining said body in said upper switch operating position when said members are in one relative position, and, upon movement of the members to a second relative position, for permitting shifting of said body along said sloped surface from said upper switch operating position to said lower switch operating position for retention thereat under the influence of gravity, said switch elements being located for movement of said body from said upper to said lower switch operating position, when said members are in said one relative position and an external magnetic is applied to said first member in an attempt to magnetically manipulate the switch assembly, the distance between said opposed upper and lower walls at the region occupied by said body when the body is in said lower position thereof being greater than the diameter of said body.

21. The switch assembly of claim 20, said upper switch element comprising an electrical contact wire located within said housing.

22. A magnetic switch assembly comprising:

a housing having therein a pair of spaced apart switch elements;

a shiftable, ferromagnetic body within said housing and shiftable between a first switch operating position wherein the body is in simultaneous engagement with said spaced switch elements, and a second switch operating position where the body is out of such simultaneous contact, there being a sloped surface supporting said body for at least a part of said shifting thereof between the first and second switch operating positions;

a magnet;

means for selectively orienting said housing and said magnet in a first relative position for causing the magnet to retain said body in one of said switch operating positions, and for permitting relative movement between said housing and said magnet to a second relative position, said body being shiftable along said sloped surface upon said relative movement to the other of said switch operating positions; and circuit means operably coupled with said switch elements and perceptible alarm means, said circuit means being operable for generating an alarm signal upon movement of said body between said one and said other switch operating positions.

23. The switch assembly of claim 22, said switch elements being located in spaced relationship to each other, with said sloped surface disposed between the switch elements.

24. The switch assembly of claim 22, said body being in contact with one of said switch elements in said second switch operating position.

25. The switch assembly of claim 22, said housing being mounted on a first member, said magnetic being mounted on a second member, said first and second members being relatively movable for permitting said relative movement between said housing and said magnet.

26. The switch assembly of claim 22, said first and second switch elements being in superposed relationship to each other.

27. The switch assembly of claim 22, said body being spherically shaped.

28. The switch assembly of claim 22, one of said switch elements presenting said sloped surface.

29. A switch apparatus for detecting relative movement between first and second members, said magnetic switch apparatus comprising:

switch means for mounting on one of said members and including a housing presenting a sloped surface and a switch assembly having a pair of switch elements, said switch assembly being switchable between a first switch position wherein said switch elements are in electrical contact with each other and a second switch position wherein said switch elements are electrically isolated from each other;

means including a shiftable, ferromagnetic body within said housing and shiftable along the length of said sloped surface for switching of said switch assembly between said first and second switch positions thereof, said body being in a first position on said sloped surface when said switch assembly is in said first switch position thereof, and said body being in a second position on said sloped surface when said switch assembly is in said second switch position thereof; and a magnet for mounting on the other of said members and oriented for retaining said ferromagnetic body in said first position on said sloped surface when the first and second members are adjacent each other in order to maintain said switch assembly in said first switch position, and for permitting said ferromagnetic body to shift along said sloped surface to said second position when said members are relatively moved in order to change the switch position of said switch assembly to said second switch position thereof.

30. The switch apparatus as set forth in claim 29, wherein one of said pair of switch elements is said sloped surface.

* * * * *